US008015851B2

(12) United States Patent
Sasaki et al.

(10) Patent No.: US 8,015,851 B2
(45) Date of Patent: Sep. 13, 2011

(54) DOWEL FORMING METHOD FOR BUCKLE BASE MEMBER

(75) Inventors: Hirokazu Sasaki, Hyogo (JP); Naofumi Nakamura, Hyogo (JP); Shigeru Morikawa, Hyogo (JP); Hideto Hashimoto, Tokyo (JP); Takaaki Kimura, Tokyo (JP); Yoshihiko Kawai, Tokyo (JP)

(73) Assignees: Nisshin Steel Co., Ltd., Tokyo (JP); Takata Corporation, Tokyo (JP)

( * ) Notice: Subject to any disclaimer, the term of this patent is extended or adjusted under 35 U.S.C. 154(b) by 554 days.

(21) Appl. No.: 12/086,929

(22) PCT Filed: Dec. 25, 2006

(86) PCT No.: PCT/JP2006/326324

§ 371 (c)(1),
(2), (4) Date: Jun. 23, 2008

(87) PCT Pub. No.: WO2007/077947

PCT Pub. Date: Jul. 12, 2007

(65) Prior Publication Data

US 2009/0019911 A1 Jan. 22, 2009

(30) Foreign Application Priority Data

Jan. 5, 2006 (JP) ..... 2006-000326

(51) Int. Cl.
*B21D 22/00* (2006.01)

(52) U.S. Cl. ..... 72/347; 72/332; 72/379.2

(58) Field of Classification Search ..... 72/324, 72/347, 379.2, 348, 349, 350, 332, 351, 412, 72/470

See application file for complete search history.

(56) References Cited

U.S. PATENT DOCUMENTS 3,812,803 A * 5/1974 Brown ..... 413/8
5,287,713 A * 2/1994 Mine et al. ..... 72/43

(Continued)

FOREIGN PATENT DOCUMENTS

JP 59-225830 * 12/1984

(Continued)

OTHER PUBLICATIONS

International Search Report issued Feb. 6, 2007 in the International (PCT) Application of which the present application is the U.S. National Stage.

*Primary Examiner* — Edward Tolan
(74) *Attorney, Agent, or Firm* — Wenderoth, Lind & Ponack, L.L.P.

(57) ABSTRACT

When forming a dowel section by performing press working on each of portions constituting side walls of a buckle base member, a die having a negative clearance with a punch portion (2) is used whose length or diameter is larger than a length or diameter of a die portion (3). The dowel section is required as a guide for a tongue inserted into a buckle and as a load receiver when a latch member is elongated at a time of collision etc. When a ratio C/t of a clearance C between the punch portion and the die portion with respect to a plate thickness t of the buckle base member is set within a range of −(30 to 5) %, no crack is generated in the root of the dowel section, and the dowel section of a shear cross-section length ≧0.25×t, a shear cross-section starting height ≧0.7×t, and a height of (0.70 to 0.95)×t is easily obtained, and the perpendicularity of the dowel section side surface is enhanced.

2 Claims, 3 Drawing Sheets

U.S. PATENT DOCUMENTS

| | | | | |
|---|---|---|---|---|
| 5,435,046 | A | 7/1995 | Miyauchi et al. | |
| 5,722,282 | A * | 3/1998 | Mine et al. | 72/348 |
| 6,205,831 | B1 * | 3/2001 | Adey et al. | 72/47 |
| 6,568,064 | B2 * | 5/2003 | Kanno et al. | 29/596 |
| 6,733,899 | B2 * | 5/2004 | Uehara et al. | 428/573 |
| 7,117,708 | B2 * | 10/2006 | Yamano et al. | 72/350 |

FOREIGN PATENT DOCUMENTS

| | | | |
|---|---|---|---|
| JP | 61-176429 | * | 8/1986 |
| JP | 1-166828 | * | 6/1989 |
| JP | 6-225804 | | 8/1994 |
| JP | 2002-096119 | | 4/2002 |

* cited by examiner (PRIOR ART)

(PRIOR ART)

DOWEL FORMING METHOD FOR BUCKLE BASE MEMBER

BACKGROUND OF THE INVENTION

1. Technical Field

The present invention relates to a method of forming a dowel (the dowel being equal to half blanking) section functioning as a tongue guide in a base member of a buckle for attaching a seat belt provided on a seat of an automobile or a vehicle for transportation.

2. Description of the Related Art

A seat of an automobile or various types of transportation vehicles is equipped with a seat belt for protecting the occupant of the seat from the impact at the time of a collision. In a seat belt, a tongue and a buckle are mounted to a seat belt web. By inserting the tongue into the buckle and locking it therein, the seat belt web is wound around the body of the occupant to constrain the same.

In the buckle, a latch member is rotatably mounted to a base member receiving the tongue, and the latch member latching the tongue is urged in the latching direction by a spring (see, for example, JP 2001-80462 A).

Abase member 11 is bent into a U-shaped member in which both side walls are opposed to each other, and inwardly protruding guide portions 11*a* and 11*b* are respectively provided on the side walls (FIG. 1). In the engagement state at the time of latching (FIG. 2), the guide portions 11*a* and 11*b* exhibit a function of guiding the inserted tongue 12. They also function as a guide and a load receiver when a latch member 13 is elongated at the time of generation of an impact or the like.

Conventional guide portions are formed as inwardly protruding dowel sections by performing press working on a part of the side walls of the base member. Recently, however, the following features are required of a buckle base member: a dowel height of approximately 90% of the plate thickness as measured from the inner surface of the base side wall; a dowel section side surface shear cross-section length L of 25% or more of the plate thickness; and a shear cross-section starting height H of 70% or more of the plate thickness. Thus, the recent requirements for the dowel section performance are rather severe. It should be noted that the shear cross-section length L refers to the length in the plate thickness direction of the shear surface appearing at the cut end surface, and the shear cross-section starting height H refers to the length in the plate thickness direction as measured from the dowel section root to the shear cross-section starting position (FIG. 4).

When a dowel section, of which there are severe requirements in terms of configuration, dimension, surface property, and the like, is formed by a conventional press working method, a crack is generated and allowed to grow from the vicinity of the punch and the die cutter at the time of working, and eventually becomes a crack extending through the plate thickness to promote exposure of a rupture surface. Exposure of the rupture surface reduces the effective contact area at the component contact position, deteriorates the smoothness of the sliding surface in the slide portion, and hinders smooth sliding motion of the tongue and the dowel section side surface.

SUMMARY OF THE INVENTION

The inventors of the present invention conducted various investigations and examinations on the metal flow at the time of formation of a dowel section by press working. In press working, the fracture generation condition greatly differs depending on the clearance adjustment; under a condition in which fracture generation is suppressed, a cut surface of large shear cross-section ratio tends to be formed. It has been found out that, from the relationship between clearance and fracture generation, that when press working is performed with a negative clearance, there is involved no stress concentration or shortage of material thickness leading to material rupture, thereby making it possible to form a cut surface of high shear cross-section ratio under a satisfactory metal flow.

Based on the findings related to the clearance action affecting fracture generation, the present invention aims to form dowel sections provided on both side walls of a buckle base member without involving any fracture generation and to finish the dowel section side surfaces as smooth surfaces of high perpendicularity by setting a negative clearance between a punch and die.

The present invention is characterized in that when performing dowel formation on the portions of a buckle base member constituting the side walls thereof by press working using a punch and a die, a negative clearance is set between the punch and the die.

It is desirable for the ratio of the clearance C to the plate thickness t of the buckle base member, C/t, to be set so as to be within a range of −(30 to 5)%. Further, in relation to the plate thickness t of the buckle base member, it is desirable to perform dowel forming of a height of (0.70 to 0.95)×t.

When performing dowel formation by press working on a buckle base member, by using a negative clearance die in which the length or diameter of the punch is larger than the length or diameter of the die, no fracture is generated at the dowel section root, which undergoes great working process, and there is formed a dowel section having a side surface of long shear cross-section and high perpendicularity. The dowel section side surface, formed by the shear cross-section, secures smooth insertion of the tongue, and also contributes to an improvement in the strength of the buckle. By performing press working using a die of negative clearance, it is possible to easily form a dowel section with the following features: the dowel section height: approximately 0.90×t; the shear cross-section length of the dowel section side surface: $L \geqq 0.25 \times t$; and the shear cross-section starting height: $H \geqq 0.70 \times t$.

DETAILED DESCRIPTION OF THE INVENTION

Figure 1:
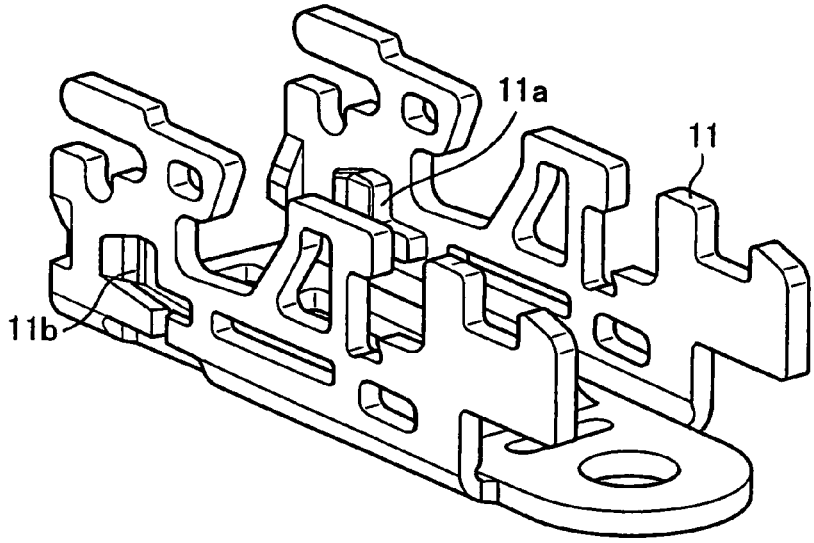
FIG. 1 is a schematic perspective view illustrating the configuration of a buckle base member.
Figure 2:
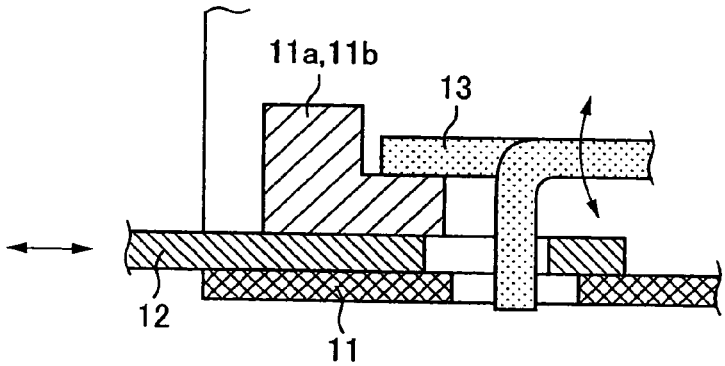
(PRIOR ART) FIG.2
FIG. 2 is a schematic sectional view showing how a guide portion of a buckle base member, a latch member, and a tongue are engaged with each other at the time of latching.
Figure 3:
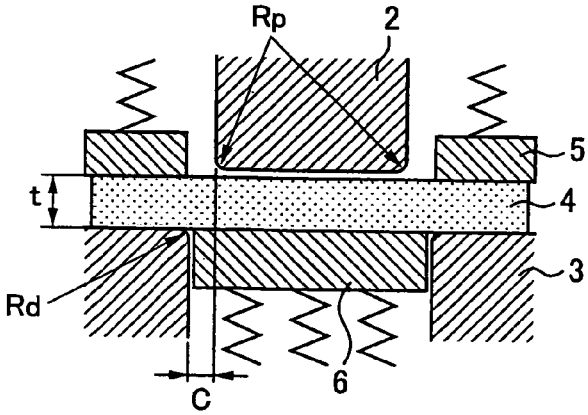
FIG. 3 is a sectional view illustrating a generally adopted die clearance at the time of press working.

Usually, a press working method using a punch and a die is adopted for dowel forming processing performed on a buckle base member. In press working, a workpiece 4 is placed on a die 3 of a predetermined configuration, and is fixed in position by a stripper plate 5. The workpiece 4 is supported from below by a counter pad 6. A punch 2 is forced in from above to shape the workpiece 4 into a configuration as defined by the die 3 (FIG. 3).

Assuming that the length or outer diameter of the punch 2 is D1 and that the length or inner diameter of the die 3 is D2, the clearance C between the punch and the die is expressed as follows: C=(D2−D1)/2. In an ordinary press working process, there is adopted a positive clearance, that is, D2>D1, and the ratio of the clearance C with respect to the plate thickness t, C/t, is set to a range of 5 to 20%.

Figure 4:
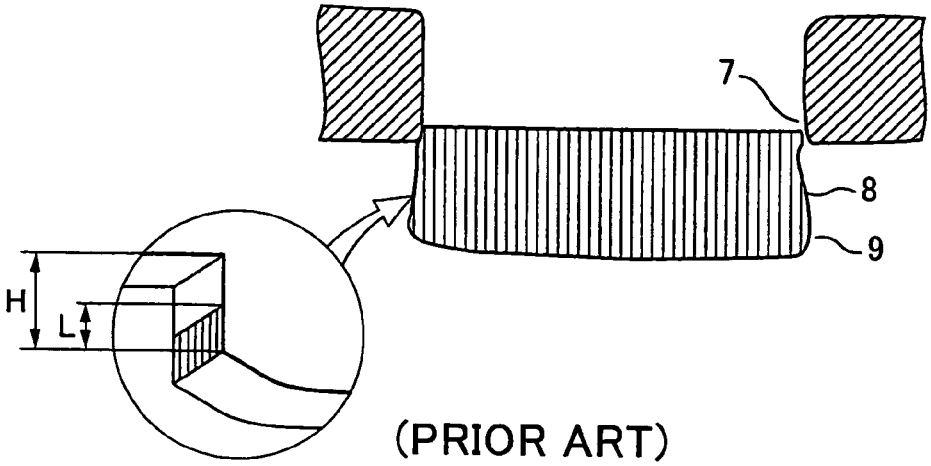
FIG. 4 is a sectional view of a buckle base member, schematically showing a conventional dowel section configuration.

When a dowel of a height of approximately 0.9×t (t: the plate thickness of the buckle base member) is formed by press working using a die of a positive clearance C, a fracture 7 (FIG. 4) is likely to be generated at the root of the dowel section. The fracture 7 appears as a rupture surface 8 on the side surface of the dowel section, and the side surface is likely to be tapered, and a shear cross-section 9 is only partially formed.

In view of this, in order to form the dowel section side surface of a shear cross-section without involving generation of a crack at the root of the dowel section and to enhance the perpendicularity of the side surface, a press working test was conducted under the condition in which the punch roundness Rp, the die roundness Rd, and the clearance were varied. As a result, it was found out that the influence of the punch roundness Rp and the die roundness Rd is small, and that the use of a negative clearance die in which the length or diameter of the punch is larger than the length or diameter of the die makes it possible to form a dowel section side surface formed of a shear cross-section and of high perpendicularity.

The reason for the great difference in dowel section configuration and surface property according to whether the die clearance is positive or negative can be illustrated as follows.

Figure 6:
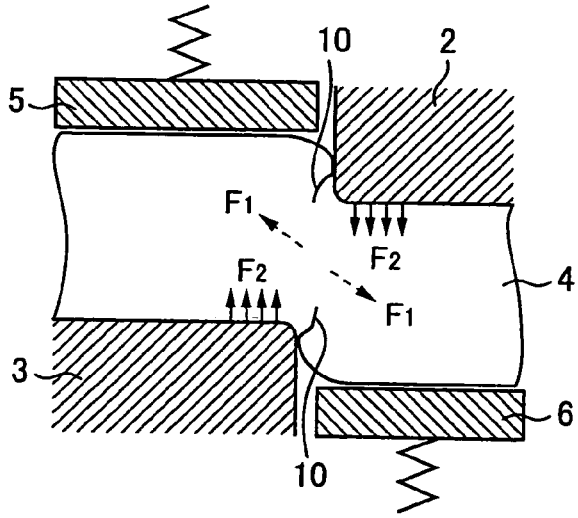
FIG. 6 is a diagram illustrating the stress state in a working process using a die of a generally adopted clearance.

In press working using an ordinary die (FIG. 3) of a positive clearance, a crack 10 (FIG. 6) is generated in the portion of the workpiece 4 in the vicinity of the forward end of the cutter due to a tensile force F1 generated inside the workpiece 4. When the punch 2 is forced into the die 3 until a dowel section of a predetermined height is formed, a fracture grows starting from the crack 10, resulting in rupture of the dowel section root. Further, compressive stresses F2 acting on the upper and lower surfaces of the workpiece 4 are deviated from each other with respect to the in-plane direction of the workpiece 4. The deviation in the in-plane direction becomes a bending moment promoting the growth of the crack 10, and also causes deterioration in the perpendicularity of the side surface.

Figure 5:
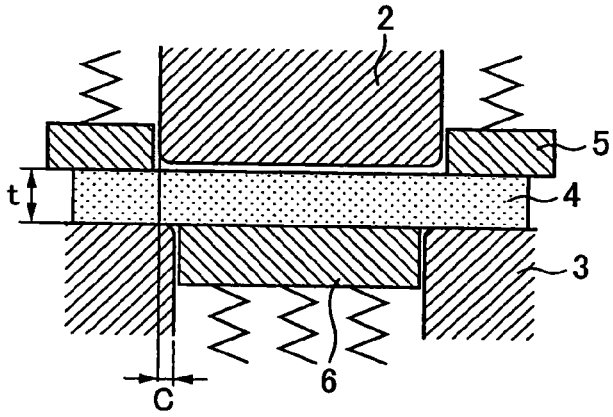
(PRIOR ART) FIG.5
FIG. 5 is a sectional view illustrating a negative clearance die adopted in the present invention.
Figure 7:
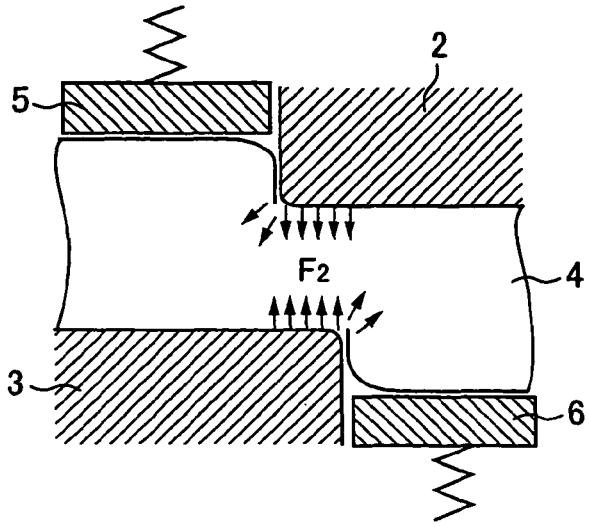
FIG. 7 is a diagram illustrating the stress state in a working process using a negative clearance die.
Figure 8:
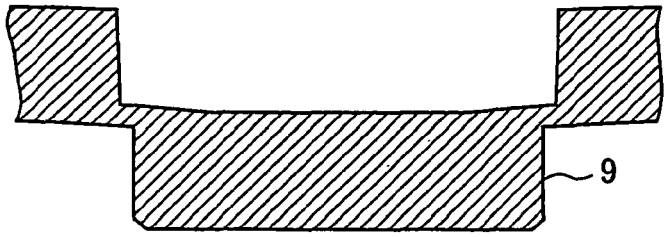
FIG. 8 is a sectional view of a buckle base member, showing the configuration of a dowel section obtained in the present invention.

On the other hand, in press working using a die of a negative clearance (FIG. 5), the compressive stresses F2 acting on the upper and lower surfaces of the workpiece 4 are not deviated from each other in the in-plane direction, and the portion of the workpiece 4 in the vicinity of the forward end of the cutter is maintained in a greatly compressed state between the punch 2 and the die 3 (FIG. 7). When press working is performed on the workpiece 4 compressed from above and below, there is generated a metal flow similar to a metal flow in forging, and the requisite thickness for the formation of a dowel section is secured, and the root of the dowel section is relatively free from fracture. Further, plastic flow of the compressed material of the workpiece 4 occurs along the inner wall of the die 3, so the dowel section side surface is formed of a shear cross-section free from rupture, and the perpendicularity of the dowel section side surface is enhanced.

The effect as obtained by adopting a negative die clearance is also attained when the absolute value of the clearance is relatively small; as the absolute value increases, the rupture surface length decreases, and the shear cross-section length L increases, and the shear cross-section starting height H increases. To secure the shear cross-section over the entire length of the dowel section side surface, it is desirable for the clearance ratio C/t to be not more than −5%. When a die whose clearance ratio is in the range: C/t≦−5% is used, it is possible to form a dowel section side surface free from generation of fracture, including a shear cross-section over the entire length, and exhibiting a very high perpendicularity.

While it is possible to obtain a dowel section side surface of high quality and satisfactory configuration with the clearance ratio of C/t≦−5%, when the absolute value of the clearance C is too large, wear of the die, in particular, the punch becomes rather intense, so it is desirable for the lower limit of the clearance ratio to be approximately −30%. From the viewpoint of imparting the guide function, the height of the dowel section is important; the larger the height is more desirable. To function as a guide, the dowel section must have a height of at least approximately 0.7×t (t: plate thickness); taking into consideration the bottom dead center precision of the press, the upper limit is preferably set to approximately 0.95×t.

As described above, when press working is performed by using a die of a negative clearance, in particular, of a clearance ratio C/t of −0.5% or less, it is possible to form a dowel section exhibiting a dowel section height in the range of 0.9×t, a shear cross-section length of L in the range of: L≧0.25×t, and a shear cross-section starting height H in the range of: H≧0.7×t, and the dowel section side surface being formed substantially at right angles.

Next, the present invention is described more specifically with reference to an example.

Figure 9:
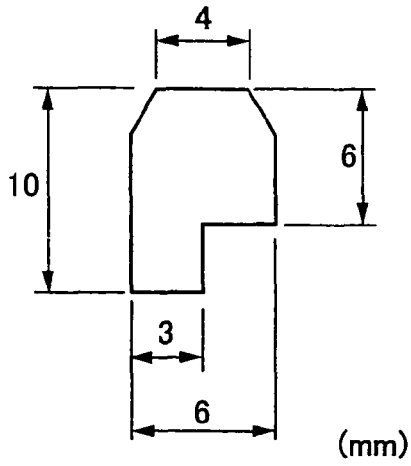
FIG. 9 is a diagram illustrating the dimensions and configuration of a dowel portion formed according to an embodiment of the invention.

Using as the material a cold-rolled steel exhibiting a yield strength of 338 MPa, a tensile strength of 511 MPa, a total elongation of 32.5%, a Vickers hardness of HV154, and a plate thickness of 2.0 mm, a dowel section of the size as shown in FIG. 9 was formed by press working, and the height of the dowel portion being 1.8 mm. In the press working, the punch roundness Rp, die roundness Rd, and clearance ratio C/t were varied as shown in Table 1.

TABLE 1

| Die condition | |
|---|---|
| Clearance ratio C/t(%) | 5, 0, −5, −10, −20, −30 |
| Punch roundness Rp (mm) | 0, 0.1, 0.2, 0.5 |
| Die roundness Rb (mm) | 0, 0.1, 0.2, 0.5 |
| Lubrication | Non-lubricated |

After the press working, the dowel section root was observed to examine it for fracture generation and the dowel section side surface condition. Press workability evaluation was made as follows: a dowel section with fracture generated in the side surface: x; a dowel section with no fracture but exhibiting a rupture surface: Δ; and a dowel section with no fracture and including a shear cross-section over the entire side surface length: O.

As can be seen from the examination results set forth in Table 2, when the clearance ratio C/t of the die was −5% or less, it was possible to form a dowel section with no fracture and including a shear cross-section over the entire side surface area. Table 2 also shows that generation of fracture and shear cross-section is not influenced by the punch roundness Rp and the die roundness Rd.

In contrast, the press working using a die of a positive clearance was subject togenerationof fracture. In the press working using a die of zero clearance, a rupture surface was likely to be generated while there was no generation of fracture; further, the perpendicularity of the dowel section side surface was rather low. In the case of dowel formation involving generation of a rupture surface and exhibiting low perpendicularity, smooth sliding of the tongue and the latch member is hindered.

TABLE 2

Influence of die condition on dowel section side surface

| Punch roundness | Die roundness | Clearance ratio C/t(%) | | | | | |
|---|---|---|---|---|---|---|---|
| Rp(mm) | Rd(mm) | 5 | 0 | −5 | −10 | −20 | −30 |
| 0 | 0 | x | x | ○ | ○ | ○ | ○ |
| | 0.1 | x | Δ | ○ | ○ | ○ | ○ |
| | 0.2 | x | x | ○ | ○ | ○ | ○ |
| | 0.5 | x | x | ○ | ○ | ○ | ○ |
| 0 | 0 | x | x | ○ | ○ | ○ | ○ |
| 0.1 | | x | x | ○ | ○ | ○ | ○ |
| 0.2 | | x | x | ○ | ○ | ○ | ○ |
| 0.5 | | x | Δ | ○ | ○ | ○ | ○ |

As described above, when press working is performed by using a die of a negative clearance in which the length or diameter of the punch is larger than the length or diameter of the die, there is no deviation in the in-plane direction of the compressive stresses applied from above and below to the portion of the workpiece in the vicinity of the root of the dowel section, and dowel formation is performed on the workpiece in the compressed state. Thus, there is generated a metal flow similar to a metal flow in forging, and the requisite material thickness for the formation of a dowel section is secured without involving fracture of the root of the dowel section, making it possible to form a dowel section having a side surface including a shear cross-section and exhibiting high perpendicularity. The dowel section of the buckle base member thus formed serves as a guide portion which guarantees smooth insertion of the tongue and which also functions as a load receiver for the latch member elongated at the time of generation of an impact or the like.

The invention claimed is:

1. A dowel forming method for a buckle base member, comprising:

when forming a dowel section by performing press working on each of portions constituting side walls of a buckle base member, using a die of a negative clearance with a punch portion whose length or diameter is larger than a length or diameter of a die portion; and applying compressive stresses involving no deviation in an in-plane direction from above and below to a portion of a workpiece constituting a root of the dowel section, wherein the press working is performed in a dowel section height of (0.70 to 0.95)×t, where t is the plate thickness of the buckle base member, and wherein the relation of a clearance C, a length or outer diameter $D_1$ of the punch portion, and a length or inner diameter $D_2$ of the die portion is set in $C=(D_2-D_1)/2$, and the clearance C is a negative.

2. A dowel forming method according to claim 1, wherein the press working is performed while maintaining a ratio C/t of a clearance C between the punch portion and the die portion with respect to a plate thickness t of the buckle base member within a range of +(30 to 5) %.

* * * * *